US006619203B2

(12) United States Patent
Philipp

(10) Patent No.: US 6,619,203 B2
(45) Date of Patent: Sep. 16, 2003

(54) ROTARY TAMPON PRINTING PRESS

(75) Inventor: Wilfried Philipp, Kornwestheim (DE)

(73) Assignee: Tampoprint AG, Korntal-Münchingen (DE)

( * ) Notice: Subject to any disclaimer, the term of this patent is extended or adjusted under 35 U.S.C. 154(b) by 0 days.

(21) Appl. No.: 10/117,130

(22) Filed: Apr. 8, 2002

(65) Prior Publication Data

US 2002/0152906 A1 Oct. 24, 2002

(30) Foreign Application Priority Data

Apr. 20, 2001 (DE) ..... 101 19 678

(51) Int. Cl.[7] ..... B41F 31/00

(52) U.S. Cl. ..... 101/335; 101/348; 101/153; 101/38.1

(58) Field of Search ..... 101/335, 364, 101/350.1, 352.11, 349.1, 153, 348, 36, 38.1, 170, 150, 350.5

(56) References Cited

U.S. PATENT DOCUMENTS

| | | | | |
|---|---|---|---|---|
| 3,903,793 A | | 9/1975 | Schubert | |
| 4,145,967 A | * | 3/1979 | Marozzi | 101/333 |
| 4,266,480 A | * | 5/1981 | Lorenzo | 101/351.2 |
| 4,885,992 A | * | 12/1989 | Duce | 101/38.1 |
| 5,392,706 A | * | 2/1995 | Drew et al. | 101/170 |

FOREIGN PATENT DOCUMENTS

DE 41 14 963 4/1995

* cited by examiner

*Primary Examiner*—Leslie J. Evanisko
*Assistant Examiner*—Leo T. Hinze
(74) *Attorney, Agent, or Firm*—Paul Vincent

(57) ABSTRACT

The invention concerns a rotary tampon printing press with vertical engraved roller and vertical tampon roller wherein the engraved roller is supplied with ink by an ink dispensing system and the ink dispensing system has an Archimedean screw for supplying the printing ink.

16 Claims, 2 Drawing Sheets

ROTARY TAMPON PRINTING PRESS

This application claims Paris Convention priority of DE 101 19 678.4 filed Apr. 20, 2001 the complete disclosure of which is hereby incorporated by reference.

BACKGROUND OF THE INVENTION

The invention concerns a rotary tampon printing press comprising an engraved roller with vertical axis of rotation, one or more tampon rollers, and an ink dispensing system for supplying ink to the engraved roller.

Rotary tampon printing presses with vertical engraved rollers are known in the art. Uniform application of ink onto the engraved roller such that the engravings are completely filled with printing ink is difficult with these rollers.

SUMMARY OF THE INVENTION

To overcome this problem, the present invention proposes that, in a rotary tampon printing press of the above-mentioned type, the ink dispensing system comprise an ink collecting trough, and an Archimedean screw immersed into the ink collecting trough for supplying the printing ink, wherein the Archimedean screw comprises a guiding means which guides the printing ink to the engraved roller.

In the inventive rotary tampon printing press, the printing ink with which the engraved roller is coated is supplied by means of an Archimedean screw from the ink collecting trough and guided via the guiding means to the peripheral surface of the engraved roller thereby supplying ink to the engravings. This system is advantageous in that it operates contact-free, in contrast to systems which use ink dispensing rollers or the like. This system is also independent of the height of the engraved roller since the Archimedean screw can supply the printing ink to any desired height.

A further development provides that the Archimedean screw, the ink trough and the guiding means are parts of the ink dispensing system. This is particularly advantageous in that the ink dispensing system can be handled separately without impairing the engraved roller or the tampon roller. The positions of the engraved roller and the tampon roller must therefore not be altered, in particular, when the printing ink is changed. Maintenance and repair are simplified since the entire ink dispensing system can be replaced.

The guiding means is advantageously formed to join onto the outlet opening of the Archimedean screw and extend to the peripheral surface of the engraved roller. This provides optimum guidance of the printing ink to its destination. In particular, the dosing gap between the guiding means and the peripheral surface of the engraved roller can be adjusted.

The Archimedean screw is preferably vertical. It is also feasible to slightly incline the Archimedean screw, in particular, in the direction of the engraved roller.

A collecting means is provided below the engraved roller for collecting excess printing ink which runs off the engraved roller. This collecting means is fashioned as a collecting trough and has an inclined bottom which feeds into the ink-collecting trough of the ink dispensing system. In this fashion, the printing ink which runs off the engraved roller is returned into the ink dispensing system.

In a particularly preferred embodiment, the Archimedean screw is driven by a speed controlling drive. This permits optimum adjustment of the capacity to the requirements or type of printing ink.

In a further development, the drive comprises a sensor for determining the power input. This sensor adjusts the power of the drive to the changing ambient conditions. Towards this end, a monitoring means is provided which comprises the corresponding control circuits. A supply device is also provided for adding thinning agent when the ink thickness exceeds a threshold value.

Preferably, the guiding means can be adjusted to the height of the engraved roller. As mentioned above, this permits use of the same ink dispensing system for engraved rollers of different heights, e.g. heights of 50 mm, 100 mm etc.

To meet environmental conditions and minimize evaporation of ink components, the system is substantially closed.

To ensure that the printing quality remains constant, the tampon roller is coupled to a residual ink collector. This residual ink collector, formed e.g. as a revolving roller to be pressed onto the tampon, bears an ink-collecting sheet around its periphery which is exchanged when required. It is, of course, also possible to press a sheet band onto the revolving roller of the tampon roller to thereby collect the residual ink.

Further advantages, features and details of the invention can be extracted from the following description which illustrates in detail a particularly preferred embodiment with reference to the drawing. The features shown in the drawing and mentioned in the description and in the claims may be essential to the invention either individually or collectively in any arbitrary combination. In the drawing:

DESCRIPTION OF THE PREFERRED EMBODIMENT

Figure 1:
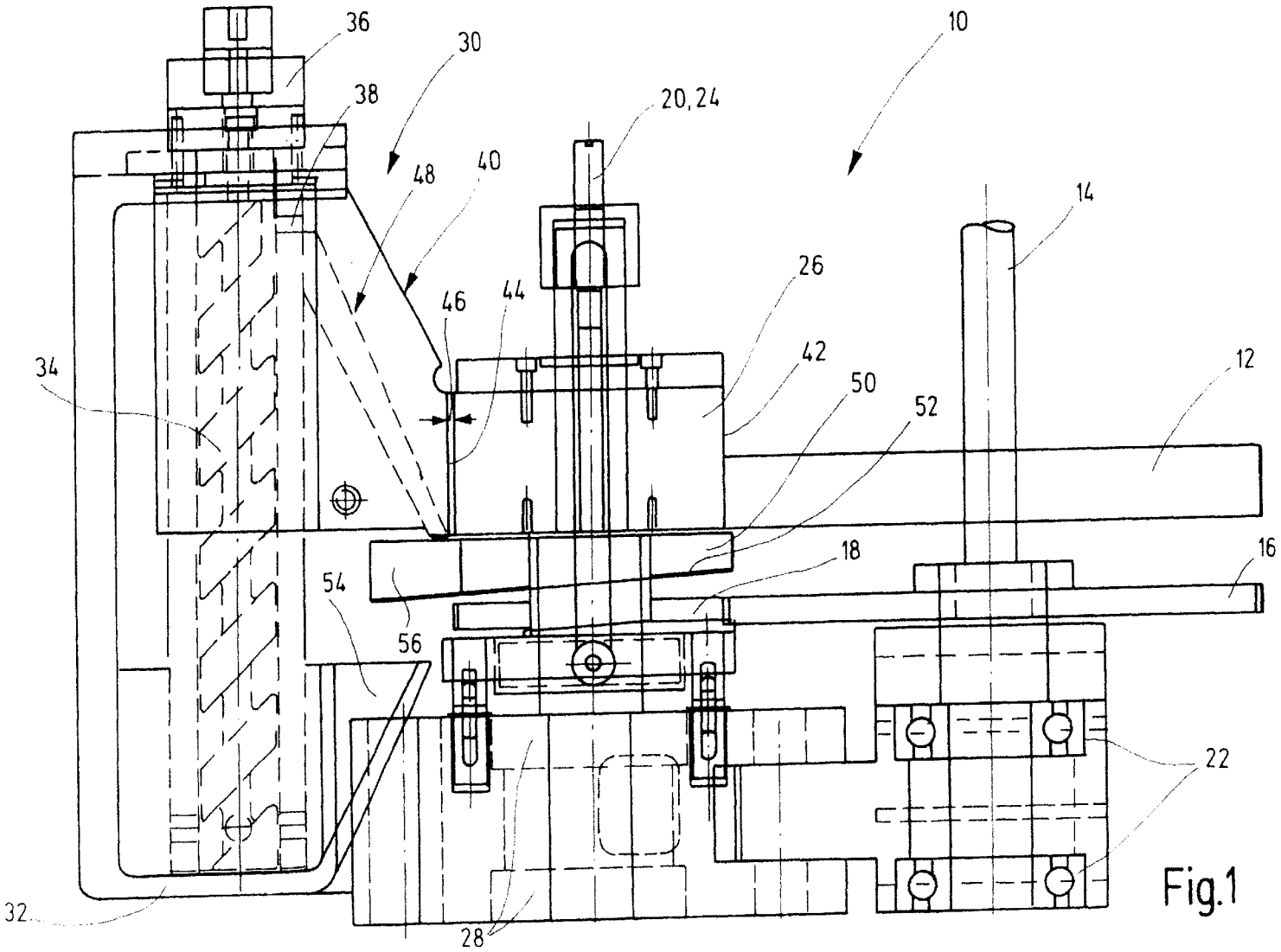
FIG. 1 shows a side view of the inventive rotary tampon printing press.

FIG. 1 shows a side view of a rotary tampon printing press, referred to in its entirety with 10, wherein 12 designates a tampon roller which is mounted to a vertical axis of rotation 14. The axis of rotation 14 is driven via a toothed wheel 16 which engages with a toothed wheel 18 mounted to a shaft 20. The axis of rotation 14 is mounted in bearings 22 with high precision.

An engraved roller 26 is mounted to the shaft 20 for secure mutual rotation therewith, the shaft forming a perpendicular axis of rotation 24, wherein the tampon roller 12 rolls over the engraved roller 26. The shaft 20 is also mounted in corresponding bearings 28 with high precision.

An ink dispensing system, referred to in its entirety with 30, is disposed on the side of the engraving roller 26 and comprises an ink trough 32 for collecting printing ink. An Archimedean screw 34, which has a perpendicular orientation and which is coupled to a drive 36 on its upper side, is immersed into this ink trough 32. The discharge opening 38 of the Archimedean screw 34 is also located on the upper portion and feeds into a guiding means 40 which is directed towards the peripheral surface 42 of the engraved roller 32. The dispensing opening 44 of the guiding means 40 is thereby located in the direct vicinity of the engraved roller 26 and is separated therefrom merely by a dosing gap 46. The dispensing opening 44 is also adjusted to the curvature of the peripheral surface 42 such that the dosing gap 46 does not change. The height of the dispensing opening 44 corresponds substantially to the height of the engraved roller 26 such that it is covered with ink over its entire periphery. The guiding means 40 is formed mainly as a channel 48 between the dispensing opening 44 and the discharge opening 38 of the Archimedean screw 34 and has a continuous downward inclination. This channel 48 empties when the Archimedean screw 34 is stopped.

A collecting means 50 is disposed below the engraved roller 26 which accepts printing ink dripping down from the peripheral surface 42, and then guides that ink in the direction of the ink trough 32. Towards this end, the collecting means 50 has an inclined bottom 52 which terminates above a collecting mouth 54 of the ink trough 32 in a chute-like outlet 56.

The drive 36 is provided with a sensor (not shown) which determines the power input of the drive 36 and which transfers that information to a monitoring means. If the power input of the drive 36 exceeds a pre-set value due to thickened printing ink, thinning agent is added to the printing ink to reduce its viscosity. This can be effected automatically via a control circuit. A level sensor can also be provided in the ink trough 32 to signal that the fill level is too low.

For simplicity, the conventional wiping blade and residual ink collector are omitted from the drawing.

Figure 2:
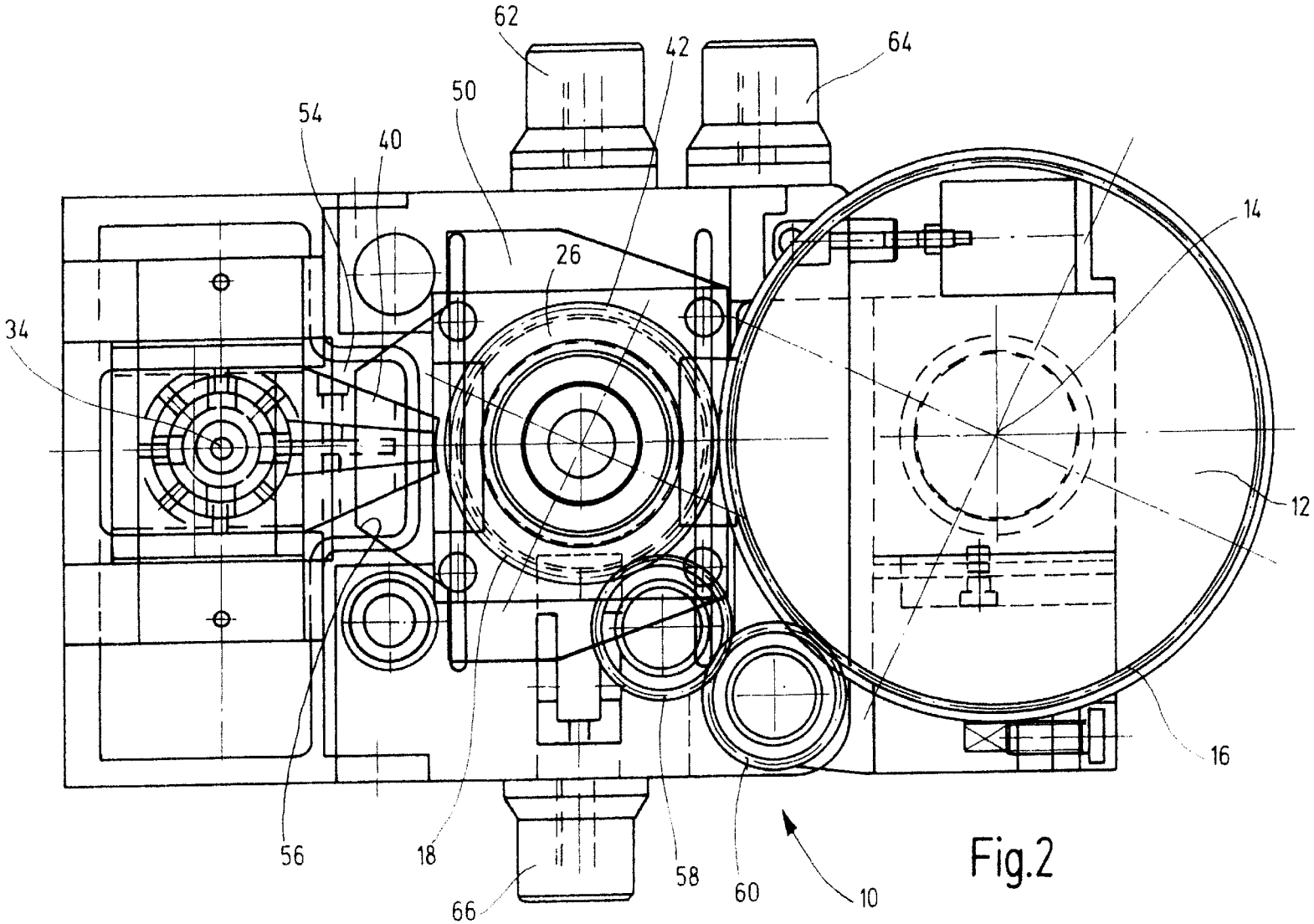
FIG. 2 shows a top view onto the rotary tampon printing press in accordance with FIG. 1.

FIG. 2 shows a top view of the rotary tampon printing press 10. The guiding means 40 is clearly shown which directly feeds into the region of the peripheral surface 42 of the engraved roller 26. Toothed wheels 58 and 60 are also shown which drive the two toothed wheels 16 and 18. The position of the engraved roller 26, the position of the tampon roller 12, the contact pressure of the tampon roller 12 on the engraved roller 26, the contact pressure of the wiping blade on the peripheral surface 42 of the engraved roller 26 and the level positions of the rollers 12 and 26 can be set by means of adjustment devices 62, 64 and 66.

It should be emphasized that the ink dispensing system 30 is a separate component which must only be replaced when changing the printing ink.

I claim:

1. A rotary tampon printing press comprising:

an engraved roller with a vertical axis of rotation;

at least one tampon roller communicating with said engraved roller;

an ink trough disposed for storing printing ink for said engraved roller;

an Archimedean screw immersed in said ink trough to transport said printing ink; and guiding means disposed between said Archimedean screw and said engraved roller for passing the printing ink from said Archimedean screw onto said engraved roller.

2. The rotary tampon printing press of claim 1, wherein said Archimedean screw is vertical.

3. The rotary tampon printing press of claim 1, wherein said guiding means can be adjusted to a height of said engraved roller.

4. The rotary tampon printing press of claim 1, wherein the system is substantially closed.

5. The rotary tampon printing press of claim 1, further comprising a residual ink collector communicating with said at least one tampon roller.

6. The rotary tampon printing press of claim 1, wherein said Archimedean screw, said ink trough, and said guiding means define an ink dispensing system.

7. The rotary tampon printing press of claim 6, wherein said ink dispensing system can be exchanged to change the printing ink.

8. The rotary tampon printing press of claim 1, wherein said guiding means extends to a peripheral surface of said engraved roller to define a dosing gap between an end of said guiding means and said peripheral surface of said engraved roller.

9. The rotary tampon printing press of claim 8, wherein said dosing gap is adjustable.

10. The rotary tampon printing press of claim 1, further comprising a collecting means disposed below said engraved roller for collecting printing ink which runs-off said engraved roller.

11. The rotary tampon printing press according to claim 10, wherein said collecting means opens into said ink trough.

12. The rotary tampon printing press of claim 1, further comprising a speed controlled drive for driving said Archimedean screw.

13. The rotary tampon printing press of claim 12, wherein said drive has a sensor for determining a power input.

14. The rotary tampon printing press of claim 13, wherein said sensor is coupled to a monitoring means.

15. The rotary tampon printing press of claim 14, wherein said monitoring means is designed for power adjustment of said drive.

16. The rotary tampon printing press of claim 14, wherein said monitoring means is coupled to a supply device for thinning agents.

* * * * *